US005564278A

United States Patent [19]

Gallivan

[11] Patent Number: 5,564,278

[45] Date of Patent: Oct. 15, 1996

[54] THERMALLY STABLE CRYOSTAT

[75] Inventor: James R. Gallivan, Pomona, Calif.

[73] Assignee: Hughes Missile Systems Company, Los Angeles, Calif.

[21] Appl. No.: 476,650

[22] Filed: Jun. 7, 1995

[51] Int. Cl.[6] ..... F25B 19/02

[52] U.S. Cl. ..... 62/51.2; 62/51.1

[58] Field of Search ..... 62/51.1, 51.2

[56] References Cited

U.S. PATENT DOCUMENTS

| | | | |
|---|---|---|---|
| 3,188,824 | 6/1965 | Geist et al. | 62/51.2 |
| 3,952,543 | 4/1976 | Buller | 62/51.2 |
| 4,080,802 | 3/1978 | Annable | 62/51.2 |

*Primary Examiner*—Ronald C. Capossela
*Attorney, Agent, or Firm*—Charles D. Brown; Randall M. Heald; Wanda K. Denson-Low

[57] ABSTRACT

A short-term thermally stable cryostat (40). The cryostat (40) pre-cools an incoming high-pressure gas, converts the gas to a cold liquid, and cools an item by allowing the liquid to acquire heat from the item and boil into an exhaust gas, while maintaining a constant flow rate of the exhaust gas to reduce thermal noise due to flow rate modulation. The cryostat (40) includes an evacuated space (58) therein containing the item to be cooled and an inner cooling volume (64). Pre-cooling fins (44) spiral around a hollow mandrel (52) within the cooling volume (64) and circulate an incoming high-pressure gas around the mandrel (52). A flow restrictor (60) receives the incoming gas from the pre-cooling fins (44) and releases it into the cooling volume (64), thereby convening the incoming gas into a cold liquid which can acquire heat from the item and boil into an exhaust gas. A pressure back plate (46) having a channel therein confines a first volume of the exhaust gas flowing past the pre-cooling fins (44) to pre-cool the incoming gas. A first flow valve (68) in communication with the pressure back plate (46) controls the flow rate of the first volume of the exhaust gas as the first volume of the exhaust gas is vented to the local atmospheric pressure air, and a second flow valve (70) in communication with an end of the mandrel (52) controls the flow rate of a second volume of exhaust gas flowing through the mandrel (52).

11 Claims, 1 Drawing Sheet

FIG. 1
PRIOR ART
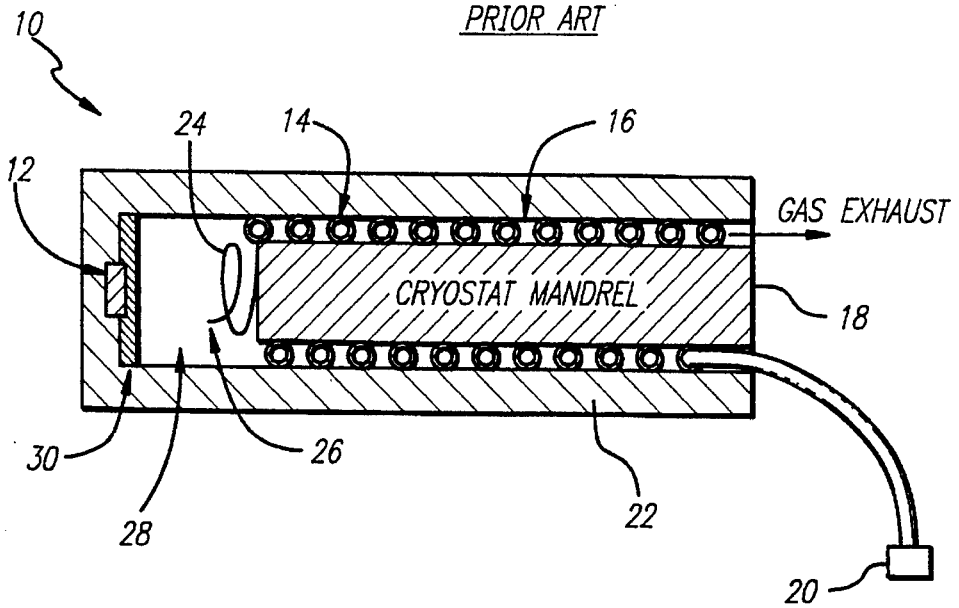
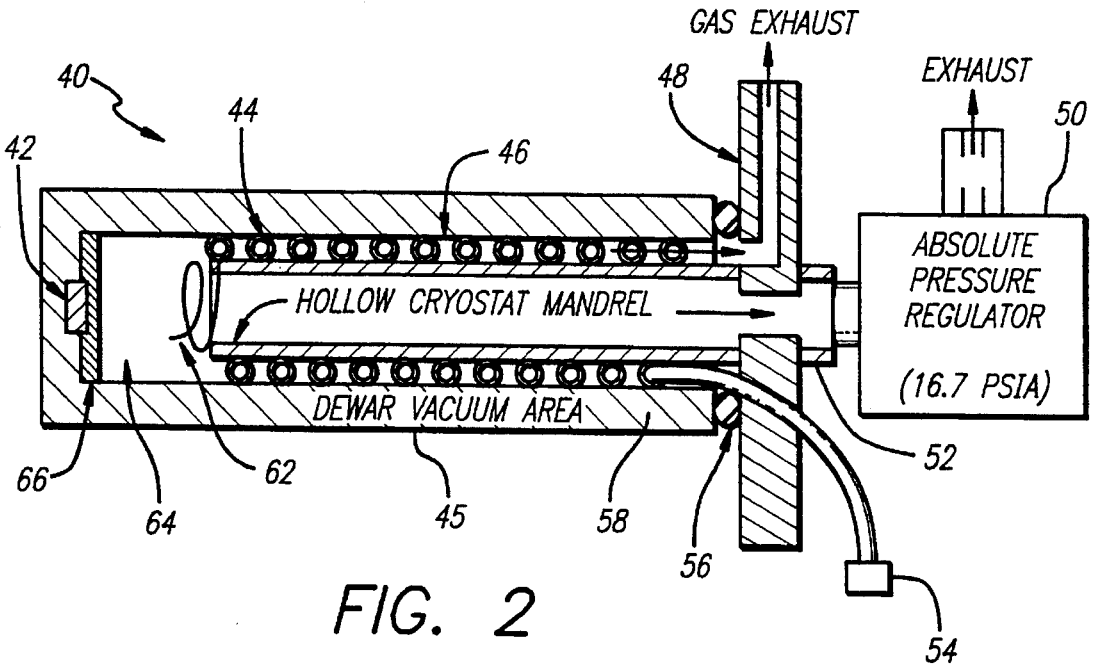
FIG. 2

THERMALLY STABLE CRYOSTAT

BACKGROUND OF THE INVENTION

1. Field of the Invention

The present invention relates to cryogenic cooling apparatus. More specifically, the present invention relates systems and techniques for reducing-thermal noise in cryostats.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

In a traditional Joule-Thompson cryostat, a high pressure gas such as nitrogen is pre-cooled and converted to a cryogenically cool liquid on expansion in a cooling volume. The liquid is used to cool a cold finger, which in turn can be used to cool, for example, an infrared (IR) sensor. The liquid boils into a gas and is sent through heat exchanger fins to cool the incoming high-pressure warm gas.

Temperature at the cold finger of a cryostat is found to vary significantly, resulting in "thermal noise". Any variation in temperature causes changes in the output signals of the DC-coupled IR sensors. Because the changes vary for each IR sensor, short-term spatial noise is induced on the output scene, with a corresponding decrease in sensitivity. The major sources of thermal noise are effects that change the pressure in the area where the liquid nitrogen is boiling, since the temperature of the boiling gas is a strong function of the absolute pressure. Flow resistance in the fins, necessary for efficient pre-cooling, converts modulation of the gas flow rate into pressure modulation, resulting in thermal noise. Liquid/gas phase changes alter the mass flow rate of the nitrogen. A change in the mass flow rate results in changes in the pressure in the cooling volume, the temperature of the liquid coolant, the ratio of liquid to gas, and the temperature and flow rate of gas flowing back from the cooling volume to the pre-cooler. The overall affect is that the cryostat flow rate oscillates due to negative thermal feedback. Because the output of the high-pressure pre-cooler line is returned to pre-cool the incoming gas and the mass flow rates are temperature sensitive, temperature oscillation occurs, producing thermal noise.

Prior efforts have focused on filtering out thermal noise, rather than reducing its causes. One filtering method involves increasing the thermal mass in order to increase the thermal time constant. Increasing the thermal mass has the disadvantage of increasing cool-down times, which can be unacceptable for tactical systems. Another noise-reduction approach is to use longer electronic filter time constants (integration time) on the electronic output of, for example, IR detectors. The disadvantage of longer electronic time constants is that they require a detector to dwell on a given scene to maintain sensitivity or increase cost by requiring more detectors to achieve the same scan times.

Thus, there is a need in the an for a short-term, thermally stable cooling cryostat with reduced temperature variation due to flow rate modulation.

SUMMARY OF THE INVENTION

The need in the art is addressed by the present invention which provides a short-term thermally stable cryostat. The cryostat pre-cools an incoming high-pressure gas, converts the incoming gas to a cold liquid, and cools an item by allowing the liquid to acquire heat from the item and boil into an exhaust gas, while maintaining a constant flow rate of the exhaust gas to reduce thermal noise due to flow rate modulation.

In specific embodiments, the cryostat includes a vessel having two walls, with an evacuated space therebetween containing the item to be cooled and the inner wall surrounding a cooling volume. Pre-cooling fins spiral around a hollow mandrel within the cooling volume and circulate an incoming high-pressure gas around the mandrel. A flow restrictor tube having a diameter smaller than the diameter of the pre-cooling fins receives the incoming gas from the pre-cooling fins and releases it into the cooling volume, thereby converting the incoming gas into a cold liquid which can acquire heat from the item and boil into an exhaust gas. A pressure back plate and an O-ring confine a first volume of the exhaust gas flowing past the pre-cooling fins to pre-cool the incoming gas. A first flow valve in communication with the pressure back plate controls the flow rate of the first volume of the exhaust gas as the first volume of the exhaust gas is vented to the local atmospheric pressure air, and a second flow valve in communication with an end of the mandrel controls the flow rate of a second volume of exhaust gas flowing through the mandrel.

BRIEF DESCRIPTION OF THE DRAWINGS

FIG. 1 is a cross-sectional view of a traditional Joule-Thompson cryostat.

FIG. 2 is a cross-sectional view of the low-noise cryostat of the present invention.

DESCRIPTION OF THE INVENTION

FIG. 1 shows a Joule-Thompson cryostat 10 of conventional design. High pressure gas such as nitrogen enters at an input port 20. The gas is spiraled around a cryostat mandrel 18 through pre-cooler fins 14 to allow the gas to be pre-cooled. The mandrel 18 is normally sealed to prevent gas from flowing through it. The gas passes into a flow restrictor 24, which is constructed of smaller-diameter tubing than the pre-cooler fins 14. When the gas exits the flow restrictor 24 through port 26, the gas pressure and temperature drop and the expelled nitrogen enters a cooling volume area 28 in a liquid state. The liquid in the cooling volume area 28 cools a cold finger 30. The cold finger 30 conductively cools the IR detectors 12 which are in a dewar vacuum area 22. The liquid acquires heat and is converted to a gas at the vaporization temperature thereof. The gas flows over the pre-cooler fins 14 between the mandrel 18 and a dewar inner wall 16, pre-cooling entering high-pressure warm gas, and is vented to the local atmospheric pressure air.

FIG. 2 depicts a low-noise cryostat 40 constructed in accordance with the teachings of the present invention. The cryostat 40 includes a pressure back plate 46 and an O-ring 56 to confine and capture pre-cooler vent gas. The O-ring 56 is formed of a material suitable to maintain flexibility at low temperatures and pressures. The pressure back plate 46 is fabricated of a metal such as aluminum with a groove formed therein to seat the O-ring, and to increase safety, may be constructed with two separate interior vent paths (not shown) so that if one path becomes blocked, pressure will not build up and cause damage. The mandrel 52 of the cryostat 40 is a hollow tube of a material such as stainless steel that has thermal expansion properties compatible with the other components. Hence, a flow path through the center of a cryostat mandrel 52 is provided. A specific flow rate absolute pressure regulator 50 is attached to an end of the hollow mandrel 52. The flow rate, needle orifices and spring pressures within absolute pressure regulator 50 must be optimized to prevent the introduction of pressure modulation noise. A high pressure gas input port 54 is connected to the pre-cooler fins 44 which spiral around the hollow cryostat mandrel 52.

A flow restrictor 60 with a port 62 in a cooling volume area 64 is connected to the pre-cooler fins 44 opposite the input port 54. A cold finger 66 in the cooling volume area 64 is disposed adjacent to IR detectors 42 which are in a dewar vacuum area 58 with a dewar inner wall 48. All components in the cooling volume area 64 must have thermal expansion coefficients sufficient to prevent breakage during rapid cooling.

As mentioned above, the assembly is sealed with the O-ring seal 56 and the pressure back plate 46. A flow valve 68 is included to control the flow rate of gas venting over pre-cooler fins 44. The pre-cooler exhaust flow valve 68 is connected to the pressure back plate 46. The cryostat 40 of the present invention further includes a flow valve 70 to control the flow rate of gas venting through the inside of the mandrel. The regulator exhaust flow valve 70 is connected to the absolute pressure regulator 50. The flow valves 68 and 70 are precision needle valves.

In operation, high pressure gas enters through the input port 54 and spirals around the hollow cryostat mandrel 52 through the pre-cooler fins 44. The gas then passes through the flow restrictor 60 and exits through the port 62 as a liquid. The liquid in the cooling volume area 64 cools the cold finger 66. The cold finger 66 conductively cools the IR detectors 42 which are in the dewar vacuum area 58. The liquid acquires heat and is converted to a gas. The gas is vented from the cooling volume area 64 through two separate vent paths. A minimal amount of gas flows over the pre-cooler fins 44 between the mandrel 52 and the dewar inner wall 48. The gas venting over the pre-cooler is sealed with the O-ring seal 56 and the pressure back plate 46 and runs to the pre-cooler exhaust flow valve 68 for quantitative adjustment. The remaining gas is vented through a new vent path down the center of the hollow mandrel 52. The gas flows through the absolute pressure regulator 50. The absolute pressure regulator 50 maintains the pressure in the cooling volume 64 at a constant value, such as 15.7 psia, allowing the cryostat to function at all altitudes and maintaining a constant long-term temperature on the cold finger. The gas runs to the regulator exhaust flow valve 70 for quantitative adjustment. The flow valves 68 and 70 are adjusted to maintain stable cryostat performance. Too little flow over the pre-cooler prevents liquid formation and the cold finger becomes warm, while too much flow causes temperature oscillation.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A thermally stable cryostat, comprising:

means for pre-cooling an incoming high-pressure gas;

means for converting the incoming gas to a cold liquid;

means for cooling an item by retaining the liquid so that the liquid acquires heat from the item and boils into an exhaust gas; and means for maintaining a constant flow rate of the exhaust gas including a pressure back plate having a vent path therein.

2. The invention of claim 1 wherein the means for maintaining a constant flow rate includes a flow valve to control the flow rate of the exhaust gas.

3. The invention of claim 1 wherein the pre-cooling means includes a mandrel.

4. The invention of claim 3 further including pre-cooling fins spiraled around the mandrel within a cooling volume for circulating the incoming gas around the mandrel and whereby a first volume of the exhaust gas flows past the pre-cooling fins to pre-cool the incoming gas.

5. The invention of claim 3 further including an O-ring disposed on the end of the mandrel to confine the first volume of exhaust gas after the first volume of exhaust gas has flowed past the pre-cooling fins.

6. The invention of claim 4 further including a flow valve in communication with the pressure back plate to control the flow rate of the first volume of exhaust gas as the first volume of exhaust gas is vented to the local atmospheric pressure.

7. The invention of claim 3 wherein the mandrel is hollow and has first and second open ends, the first end disposed to receive a second volume of the exhaust gas from a cooling volume and the second end being open to local atmospheric pressure.

8. The invention of claim 7 further including a flow valve in communication with the second end of the mandrel to control the flow rate of the second volume of exhaust gas.

9. The invention of claim 4 wherein the converting means includes a flow restrictor tube having a diameter smaller than the diameter of the pre-cooling fins and positioned to receive the incoming gas from the pre-cooling fins and release the incoming gas into the cooling volume.

10. The invention of claim 4 further including a cold finger, disposed in the cooling area adjacent to the item to be cooled, for transferring heat from the item to the cold liquid.

11. A short-term thermally stable cryostat, comprising:

a vessel having inner and outer walls, the space between the walls being evacuated to form a vacuum area containing an item to be cooled and the inner wall surrounding a cooling volume;

a hollow mandrel and pre-cooling fins spiraled around the mandrel within the cooling volume, the pre-cooling fins circulating an incoming high-pressure gas around the mandrel;

a flow restrictor tube having a diameter smaller than the diameter of the pre-cooling fins and positioned to receive the incoming gas from the pre-cooling fins and release the incoming gas into the cooling volume, thereby converting the incoming gas into a cold liquid which can acquire heat from the item and boil into an exhaust gas;

a pressure back plate disposed at the end of the mandrel to confine a first volume of the exhaust gas flowing past the pre-cooling fins to pre-cool the incoming gas;

a first flow valve in communication with the pressure back plate to control the flow rate of the first volume of the exhaust gas as the first volume of the exhaust gas is vented to the local atmospheric pressure air; and a second flow valve in communication with an end of the mandrel to control the flow rate of a second volume of the exhaust gas flowing through the mandrel.

* * * * *